US005099529A

United States Patent [19]

Anderson

[11] Patent Number: 5,099,529

[45] Date of Patent: Mar. 31, 1992

[54] BED FRAME ASSEMBLY

[76] Inventor: Robert F. Anderson, 5300 13th St., Menominee, Mich. 49858

[21] Appl. No.: 678,644

[22] Filed: Apr. 1, 1991

[51] Int. Cl.[5] ..... A47C 19/00

[52] U.S. Cl. ..... 5/400; 5/308; 5/201

[58] Field of Search ..... 5/201, 202, 400, 308; 312/257.1, 335, 336, 337

[56] References Cited

U.S. PATENT DOCUMENTS

| | | | |
|---|---|---|---|
| 2,483,938 | 10/1949 | Royston | 5/308 |
| 4,110,854 | 9/1978 | Sjolie | 5/308 |
| 4,196,948 | 4/1980 | Gavel et al. | 312/257.1 |
| 4,597,117 | 7/1986 | Sumner | 5/308 |
| 4,675,929 | 6/1987 | Santo | 5/308 |
| 4,750,794 | 6/1988 | Vegh | 312/257.1 |
| 4,788,727 | 12/1988 | Liu | 5/202 |
| 4,807,315 | 2/1989 | Wachenheim | 5/308 |
| 4,934,765 | 6/1990 | Slifer, Sr. et al. | 312/348.2 |

FOREIGN PATENT DOCUMENTS

| | | | |
|---|---|---|---|
| 218496 | 7/1924 | United Kingdom | 5/308 |

OTHER PUBLICATIONS

Waterbed Magazine, Jun. 1988, p. 34.
REP Corporation Brochure, Jun. 1989.

*Primary Examiner*—Renee S. Luebke
*Assistant Examiner*—Michael Milano

[57] ABSTRACT

The disclosed invention is to a bed frame assembly which is of an adjustable width to support various sizes of mattresses and springs. In general the assembly comprises two rectangular frame units positioned in spaced apart side by side relationship and held a predetermined distance apart by an adjustable spacer member or members. Storage drawers and a storage compartment are a part of the frame assembly.

10 Claims, 7 Drawing Sheets

BED FRAME ASSEMBLY

BACKGROUND OF THE INVENTION

1. Field of the Invention

The present invention relates to a pedestal or frame for supporting a bed spring and mattress, and more particularly is directed to a bed pedestal for supporting a spring and mattress which can accommodate such sleeping aids of different widths, e.g. commonly identified as: twin, regular, queen or king size mattresses, coil springs and box springs.

2. Description of the Prior Art

Bed pedestals or frames, especially for supporting waterbeds, are known in the art, e.g. U.S. Pat. No. 4,391,008. In many instances these are provided with drawers and/or compartments to give storage space within the pedestal, e.g. U.S. Pat. Nos. 4,617,689, 3,745,596, 4,613,999 and 2,462,524. A large segment of the bed market; i.e. that which uses conventional springs and mattresses, cannot adapt to these pedestals because of the wide variety of mattresses and spring widths. A readily assemblable storage containing pedestal for supporting such conventional sleeping surfaces, as well as accommodating a head board, is desired. Further, the manufacture of bed frames and pedestals is a competitive business which relies heavily on shipping, storing and merchandising such furniture in kit form. Compact kits are desired. Ease of assembly by persons of relatively little skill in furniture assembly, both the retail merchant and user, is essential. Assembly by use of a few common carpenter's hand tools is highly desirable.

Based on the prior art, apparently there is a need for a storage containing bed frame, or pedestal, which is adjustable in assembly to accommodate conventional mattress and spring of any predetermined width, which easily can be assembled without knowledge of a high degree of carpentry skills and by using only a screwdriver.

SUMMERY OF THE INVENTION

The basic bed frame pedestal of the present invention comprises a substantially rectangular unit. For wider mattresses, two of these are placed side by side in a spaced apart relationship, separated by support spacers of adjustable length. Each rectangular unit comprises two side panels, a footboard and headboard. It has a plurality of spaced apart internal divider panels extending between the two side panels. Each rectangular unit is fitted with at least one drawer and usually plurality of drawers which slide inwardly and outwardly from one of the side panels. For wider mattresses, storage space also is provided in the open volume between the two units, the width of this being defined by the length of the adjustable support spacers.

Objects and advantageous features of the present invention which are believed to be novel and unobvious over the known art are set forth in the description of the specification taken in conjunction with the Figures of the drawing which fully support the appended claims.

DESCRIPTION OF THE PREFERRED EMBODIMENTS

The following description will enable anyone reasonably skilled in using a simple hand tool, i.e. a screwdriver, to assemble the novel bed frame of the present invention. It also sets forth the best mode contemplated by the inventor for making and using the present invention.

Figure 1:
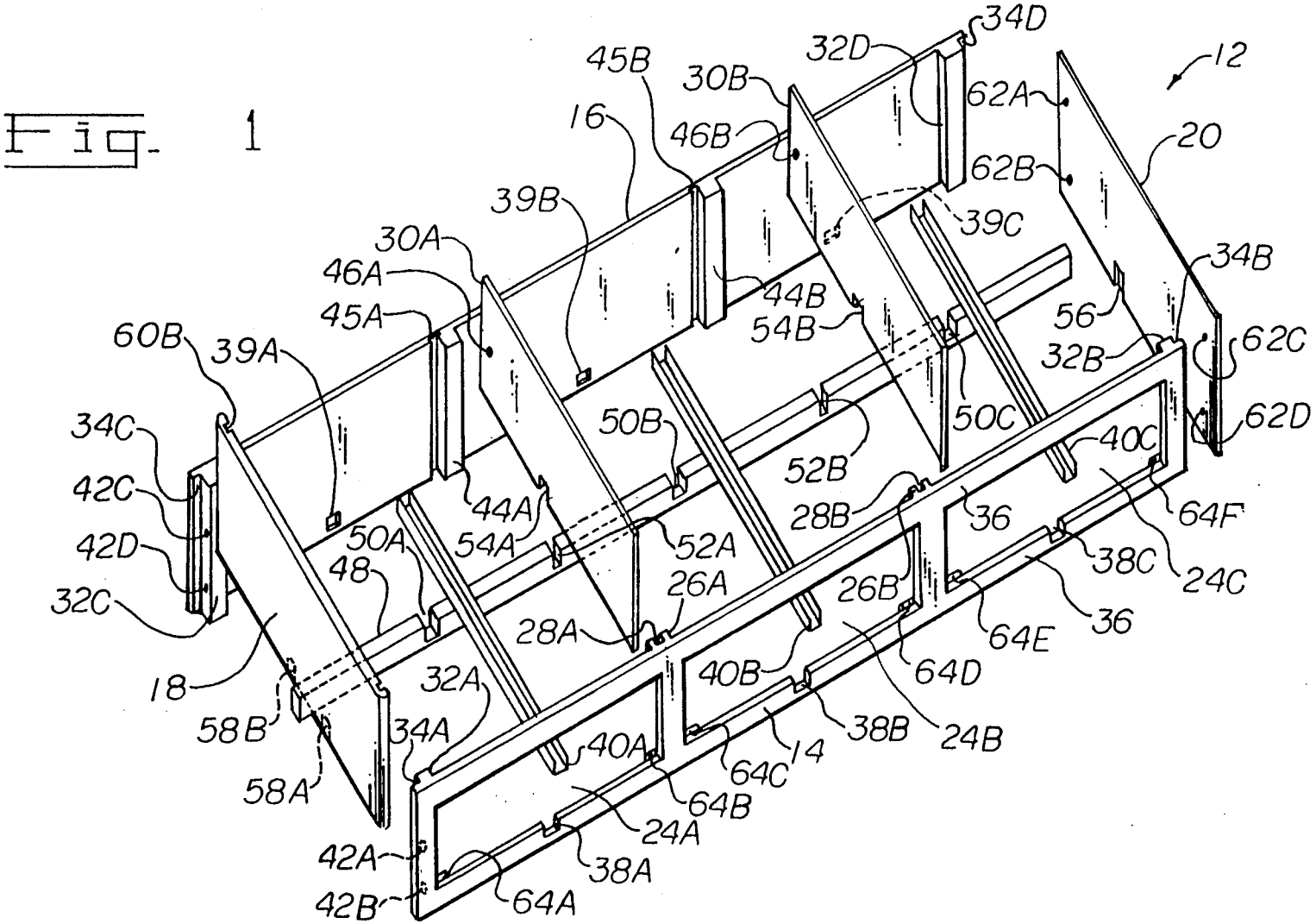
FIG. 1 is an exploded, side perspective view of a basic rectangular pedestal frame building unit of the present invention.

FIG. 1 discloses a side perspective view of a basic bed frame 12. Hereinafter, the terms "frame" and "pedestal" will be used interchangeably to describe the support unit of the present invention.

Figure 2:
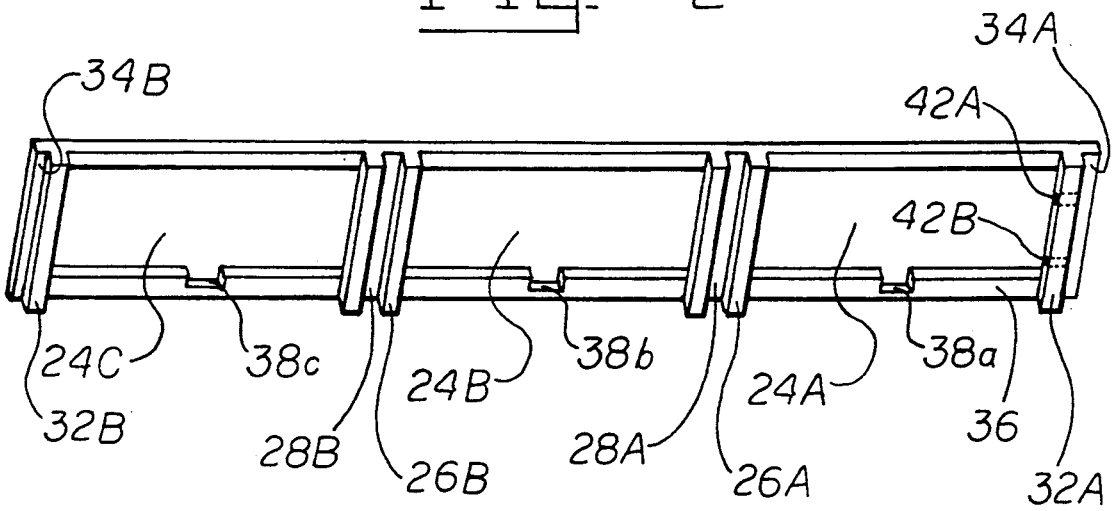
FIG. 2 is a side perspective view of the interior side of a first side panel of the frame unit of FIG. 1.

In the embodiment shown in FIG. 1 the substantially rectangularly shaped basic unit 12 is composed of two side panels 14 and 16, a footboard 18 and a back board 20. Side panel 14, which in the assembled pedestal serves as a frame for holding storage drawers 22, defines three rectangular openings 24A, 24B and 24C for receiving drawers 22. As shown in FIG. 2, the interior face of panel 14 contains two vertical support members 26A and 26B containing slots 28A and 28B fixed to panel 14 between opening 24A, 24B and 24B, 24C. Slots 28A and 28B are designed respectively to slidably engage one end of an interior divider panel 30A or 30B. Vertical support members 32A and 32B are attached, one each, near the ends of panel 14 being positioned inwardly a short distance from the end of the panel 14 such that both define identical open face right-angle notches 34A and 34B extending from the top to the bottom of panel 14. By having identical notches 34A and 34B at each end of the panel 14, the need for stocking mirror images of panel 14 for left and right hand facing drawer assembly, depending on the bed position in a room, is eliminated. This innovation also reduces confusion and simplifies assembly by the retailer or user while at the same time reducing manufacturer's inventory.

In the center of the lower edge of each of the rectangular openings 24A, 24B and 24C defined by stringer 36 of panel 14, are vertical-walled right angled notches 38A, 38B and 38C. These notches, 38A, 38B and 38C automatically locate and hold the bottom segment of drawer slides 40A, 40B and 40C, thus further facilitating assembly. Use of center drawer slides permits wider drawer width. Another novel feature of the present invention is that the residual wood pieces resulting from the generation of openings 24A, 24B and 24C, by cutting panel 14 from a single plank of wood, are not wasted, but utilized in drawer construction.

Preferably vertical end support 32A is predrilled horizontally at spaced-apart intervals along its length to define openings 42A and 42B, which serve as screw guides for facilitating fastening footboard 18 to panel 14.

Figure 3:
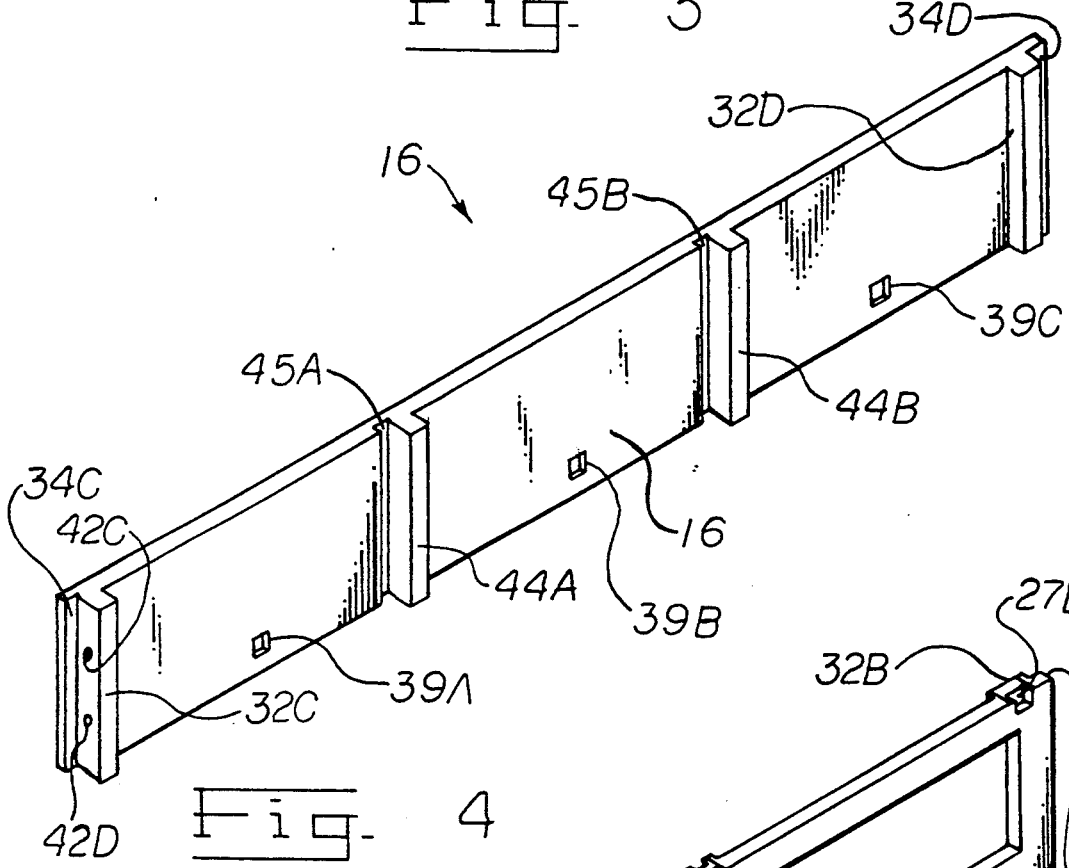
FIG. 3 is a side perspective view of one embodiment of a second side panel of the frame unit of FIG. 1.

One embodiment of second side panel 16, as shown in detail in FIG. 3, is of the same size as first side panel 14 and contains vertical supports 32C and 32D mounted to provide notches 34C and 34D which are identical with supports 32A and 32B and notches 34A and 34B. Support 32C also is predrilled to define openings 42C and 42D which are the same as 42A and 42B and also serve as guides to facilitate fastening the footboard 18 to panel 16.

Panel 16 differs from panel 14 in that it is a solid member. If desired, panel 16 can be designed to have blind openings 39A, 39B and 39C in its interior face which locates and holds one end of drawer slides 40A, 40B and 40C and eliminates the need for fastening this end to the frame. Attached to the interior face of panel 16 at spaced apart intervals are vertical supports 44A and 44B. These are equal in number to vertical members 26A and 26B but do not contain slots. Panel 16 contains slots 45A and 45B centered with respect to slots 28A and 28B in vertical supports 26A and 26B such that when each of spacer panels 30A and 30B is fitted into slots 28A and 28B respectively they are positioned vertically with respect to the first panel 14 and second panel 16. Slots 45A and 45B serve as guides for positioning supports 44A and 44B as they are fastened to panel 16 during assembly. To provide stability, the panels 30A and 30B are fastened near their ends positioned in slots 45A and 45B to the side of supports 44A and 44B by means of one or more screws. Preferably, panels 30A and 30B will be predrilled to define a guide hole 46A and 46B which facilitates assembly. Again, preferably the length of panels 30A and 30B will be such that their ends will abut the bottom of grooves 45A and 45B in panel 16. Usually panel 16 with the solid back, as shown in FIG. 1 is used in pedestal 12 for supporting a twin size, i.e. 39 inch (99 CM) width mattress, since only one unit is used as the frame. However, if desired, this panel 16 can be used as one side of one or both units when these are used as pairs for supporting standard double 54 inches (137 cm) wide, or queen or king size, 78 inches (198 cm) wide, or other predetermined widths of mattresses. The solid panel 16 simplifies production, dust proofs the drawers and provides a smooth walled center storage compartment.

If desired this second panel of the frame 12 can be a second panel 14, i.e. containing openings 24A, 24B and 24C in a frame used with a twin-sized mattress and box spring. In this assembled bed, this second side can be placed adjacent a wall, or alternatively, these openings 24A, 24B and 24C can be covered with a decorative cardboard, wood paneling, plywood or the like. The advantage of using two panels 14 even in an assembly for a twin bed is that it gives the flexibility of using either a left or right-handed drawer configuration without having to make a decision as to the positioning of footboard 18 or backboard 20.

Positioned intermediate panels 14 and 16 and extending lengthwise is a bottom support stringer 48. Stringer 48 has three vertical wall right-angle notches 50A, 50B and 50C, positioned directly opposite notches 38A, 38B and 38C in stringer 36 of first panel 14. These notches 50A, 50B and 50C locate and hold the second end of drawer slides 40A, 40B and 40C. Stringer 48 also contains notches 52A and 52B in line with slots 28A and 28B and vertical grooves 45A and 45B, depending which embodiment of side panels 14 and 16 are used to which panels 30A and 30B are fastened. Notches 52A and 52B mate with notches 54A and 54B in the bottom of panels 30A and 30B. The notches 52A and 52B and 54A and 54B are of a depth such that when panels 30A and 30B are positioned between panels 14 and 16 or two panels 14 such that they interlock when the tops of panels 30A and 30B are flush with the tops of panels 14 and 16, stringer 48 is held in position by panels 30A and 30B.

Panels 30A and 30B are not notched when used between identical side panels 14. Also stringer 48 is omitted in assembly 94 of FIG. 6.

The length of stringer 48 is such that it is flush with the outside face of backboard 20, fitting into a notch 56 at the bottom of the backboard 20. The other end of the support member 48 fits snugly within one of the blind notches 58A or 58B in the inside wall of footboard 18. The length of support 48 is determined such that it abuts the back wall of notch 58A or 58B in the inside wall of footboard 18. The spacing and positioning of notches 58A and 58B is such to permit the drawers 22A, 22B and 22C to be opened from either side of the bed depending on the position of panel 14 and stringer 48 in the pedestal unit 12.

Figure 5:
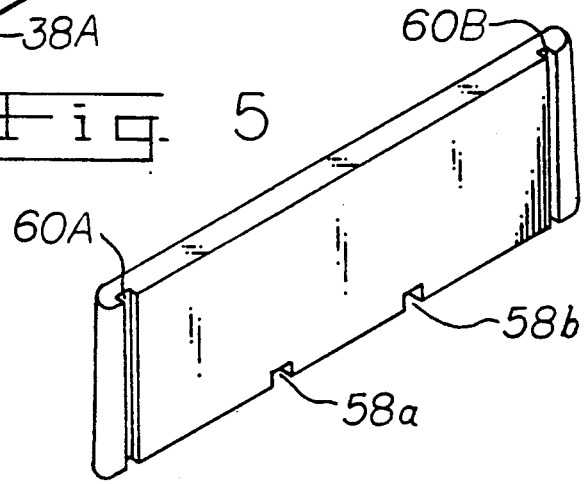
FIG. 5 is a side perspective view of the foot board of the frame unit.
Figure 6:
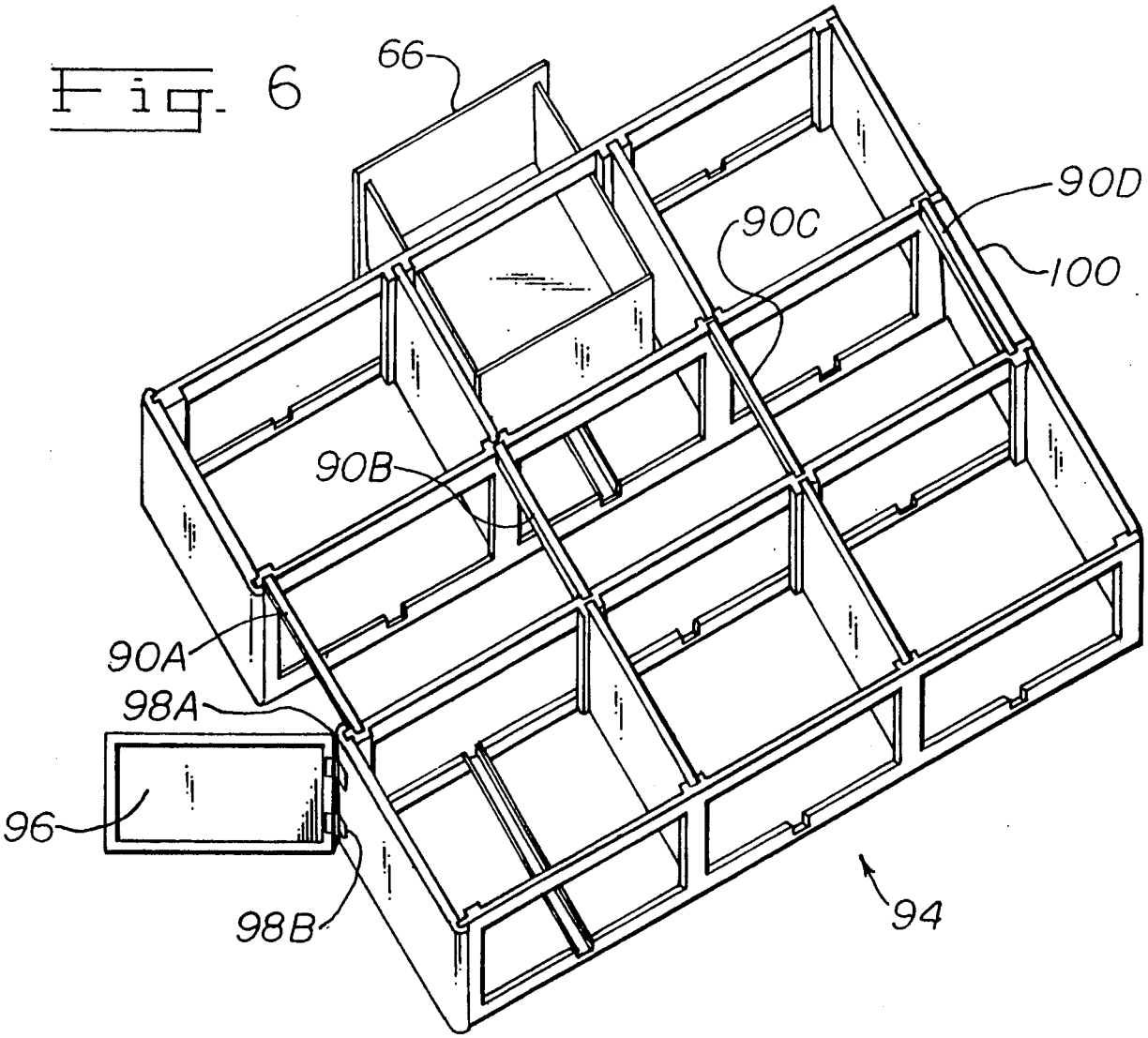
FIG. 6 is a side perspective view of a bed frame assembly of the present invention wherein two of the basic units of FIG. 1 have been joined together and also showing one of the drawers partially in place.
Figure 7:
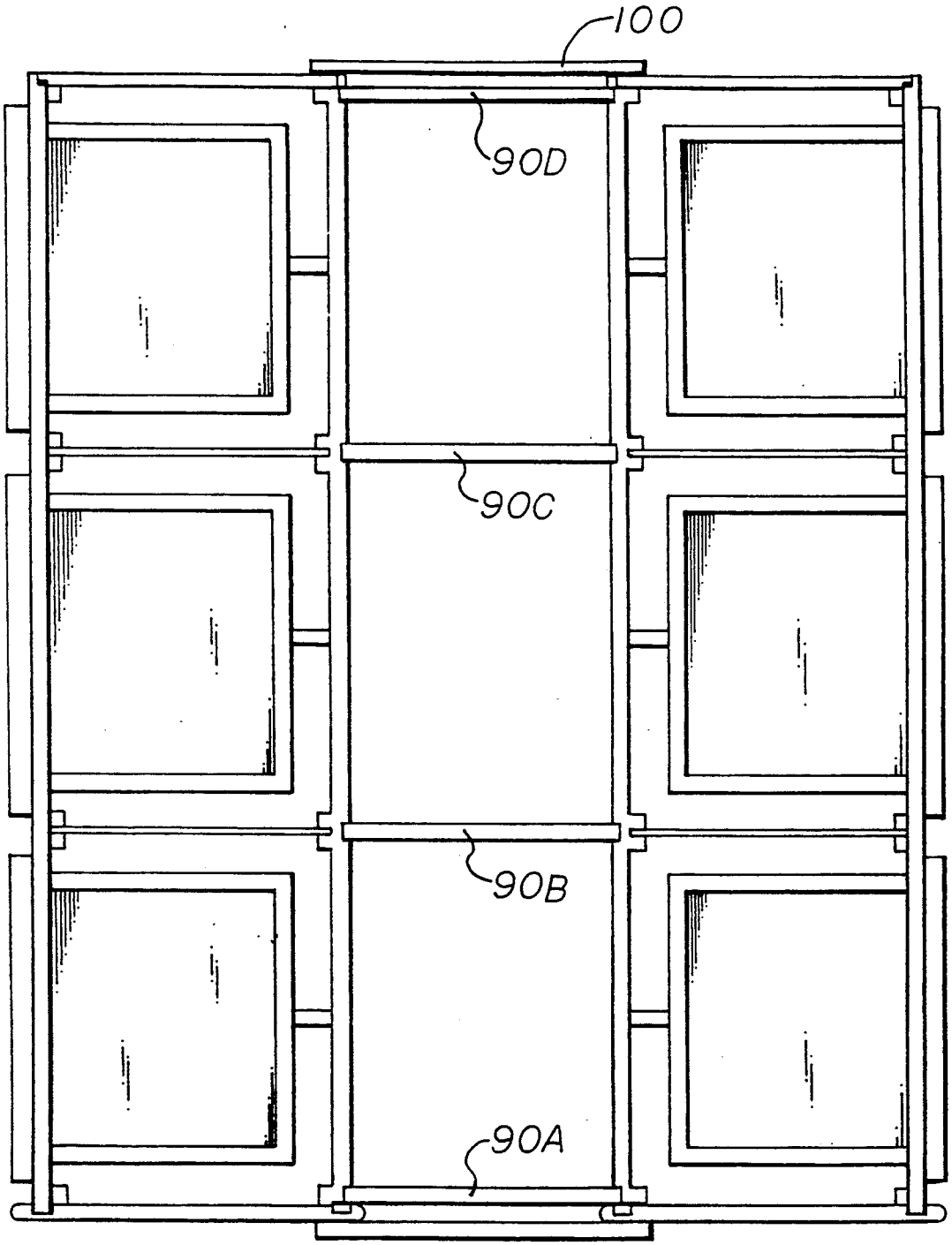
FIG. 7 is a top plan view of the bed frame assembly of FIG. 6 showing all drawers and the storage compartment.

The footboard 18 as depicted in FIG. 5 contains vertical walled grooves 60A and 60B extending from top to bottom and positioned near the ends. These grooves 60A and 60B mate with the outer extensions of notches 34A and 34C of panels 14 or 16 respectively. The height of board 18 is such that when attached to panels 14 or 16, its top and bottom are flush with those of the panels. Footboard 18 usually is positioned and fastened to panels 14 or 16 by screws using the predrilled guideholes 42A, 42B, 42C and 42D. For esthetic purposes the ends of footboard 20 can be rounded as shown in FIG. 6 or otherwise designed.

Backboard 20, which also is of a height the same as panels 14 or 16, has a length which provides a snug fit as it is positioned inside notches 34B and 34D or panels 14 or 16. Preferably, the thickness of the backboard 20 should be the same or thicker than the width of the notches 34B and 34D. As with certain other members of this invention, preferably predrilled guideholes such as 62A, 62B, 62C and 62D in backboard 20 will aid in positioning and fastening this member to the supports 32B and 32D. If desired, panel 16 can be fitted with blind openings 39A, 39B and 39C which locate and hold one end of drawer slides 40A, 40B and 40C.

The drawer slides 40A, 40B and 40C usually are of conventional metal construction and can be selected from those readily available from commercial sources; the design is such that its ends fit into notches 38A, 38B and 38C of stringer 36 and 50A, 50B and 50C of support 48 being fastened thereto, usually by a screw at each end.

The lower corners of the bottom edge of drawer openings 24A, 24B and 24C of stringer 36 of panel 14 may be fitted with conventional drawer rollers 64A, 64B, 64C, 64D, 64E and 64F, if desired, to promote ease of drawer opening. As provided to the retailer or user the vertical supports 26A, 26B, 32A, 32B, 32C, 32D, 44A and 44B come preattached to panels 14 or 16.

The length of the pedestal unit 12 is predetermined to fit a given mattress, either standard length or extra long. The overall width is about 39 inches with a drawer depth of about 18 inches. As depicted in the Figures of the drawing, the drawers 22 are shown as being of equal width and of three per pedestal unit 12. If desired, both the size and number of drawers per unit can be altered. Also, it is not essential that they all be of the same size, but such alternatives might require somewhat more complex operations in manufacture and assembly.

Figure 8:
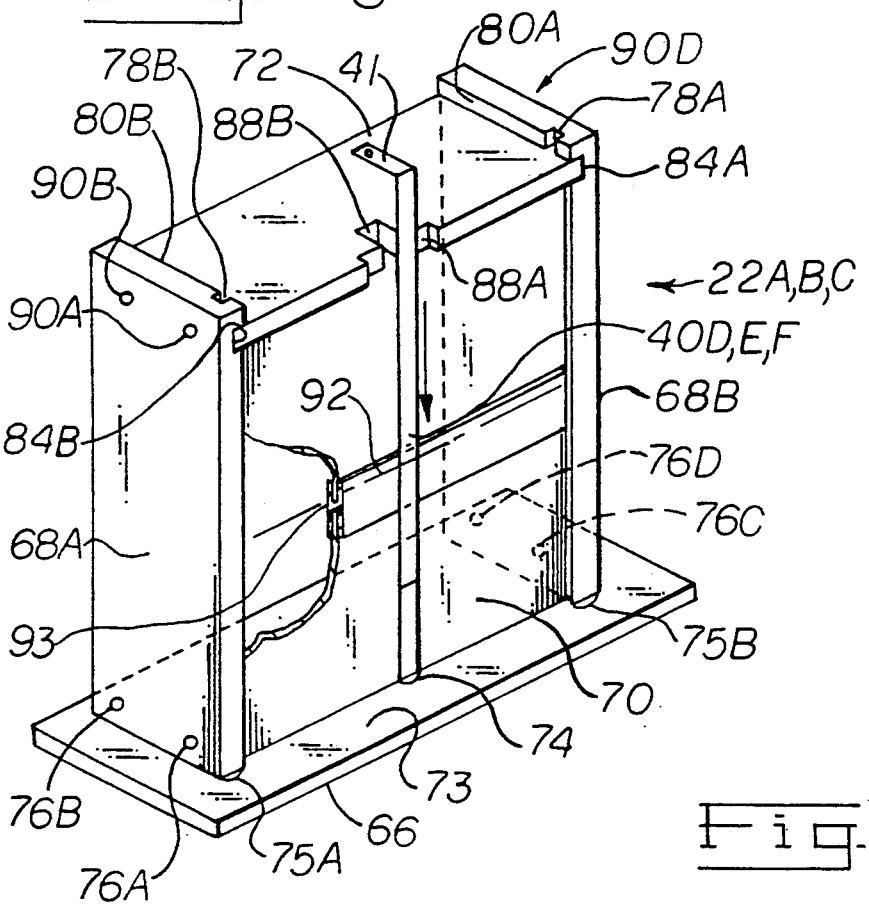
FIG. 8 is a side perspective view of a drawer which fits into the frame units.
Figure 9:
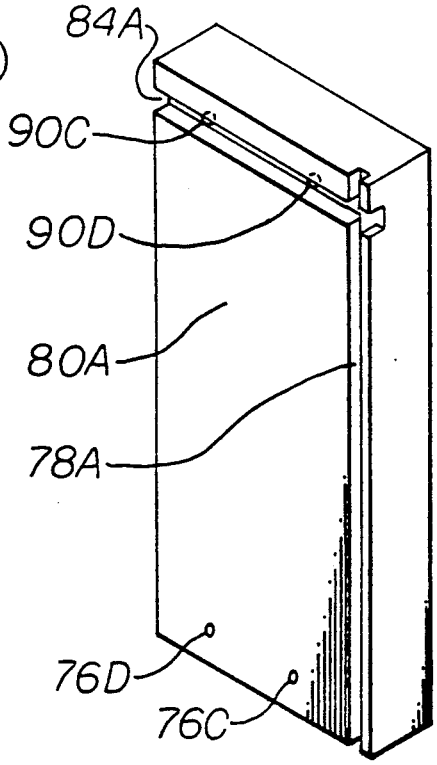
FIG. 9 is a side perspective view of a drawer side of the drawer of FIG. 8.

The drawers 22A, 22B and 22C, as depicted in FIG. 8 disclose a further innovative feature of the invention. Each of the units 22A, 22B and 22C comprises a front 66, two sides 68A and 68B, a bottom 70 and a back 72. The drawers 22A, 22B and 22C are substantially identical and thus interchangeable as used in the pedestal 12. This feature further eases assembly by the retailer or user. The drawer front 66 is of a size larger than opening 24A, 24B and 24C in panel 14. The middle of the inside face 73 of drawer front 66 contains a depression 74 near the bottom designed to hold in place one end of the second half of drawer slide 40A, 40B or 40C, which mates with drawer slide member 40D, 40E or 40F and holds the one end in place without the need of an additional fastener. Drawer face 73 also has vertical grooves 75A and 75B at predetermined distances inwardly from its ends such that one end of each of the drawer sides 68A and 68B fits snugly therein. The positioning of sides 68A and 68B provides that these fit snugly but slidably within the side walls defining opening 24A, 24B or 24C in panel 14. Preferably, sides 68A and 68B have angularly downwardly pre-drilled holes 76A, 76B, 76C and 76D near the ends fitted in grooves 75A and 75B to facilitate securing the sides 68A and 68B to the drawer front 66 with screws or other fastening means. Each side member 68A and 68B has narrow grooves 78A and 78B in the interior face 80A and 80B near the edge which will be near the bottom of a drawer 22 and slidably engage drawer bottom 70. These extend horizontally along the length of each side 68A and 68B. Drawer bottom 70 is slid into these grooves 78A and 78B during assembly. Sides 68A and 68B also each contain a vertical groove 84A and 84B near the end opposite that which fits into depressions 75A and 75B. These grooves 84A and 84B hold the back 72. Back 72 can contain a horizontal slot (not shown) which mates with the grooves 78A and 78B to help position and hold the bottom 70. Back 72 has a slot 88B which is centrally positioned to automatically locate and hold the second end of slide 40D, 40E or 40F. This second end of slide 40D, 40E or 40F has a right angle tail 41 which fits snugly into slot 88B and is fastened with a screw. Back 72 also has a notch 88A which is also centrally located and is of a size and configuration to allow passage of mating drawer slide 40A, 40B or 40C of the drawer 22 when the drawer 22 is opened or closed. Side members 68A, 68B preferably will have spaced-apart predrilled openings 90A, 90B, 90C and 90D positioned such that screws or other appropriate fasteners will pass through and be guided into the ends of back 72. To reduce size for shipping, the drawer bottom 70 can be made in one piece folded over along its center line 92, or two pieces, generally of the same shape and size i.e. substantially identical which can be taped together at their mating edges or the two pieces can be joined, for example, by means of a shaped extrusion 93 to reduce width for packaging without destroying the integrity of this member, 70.

Figure 4:
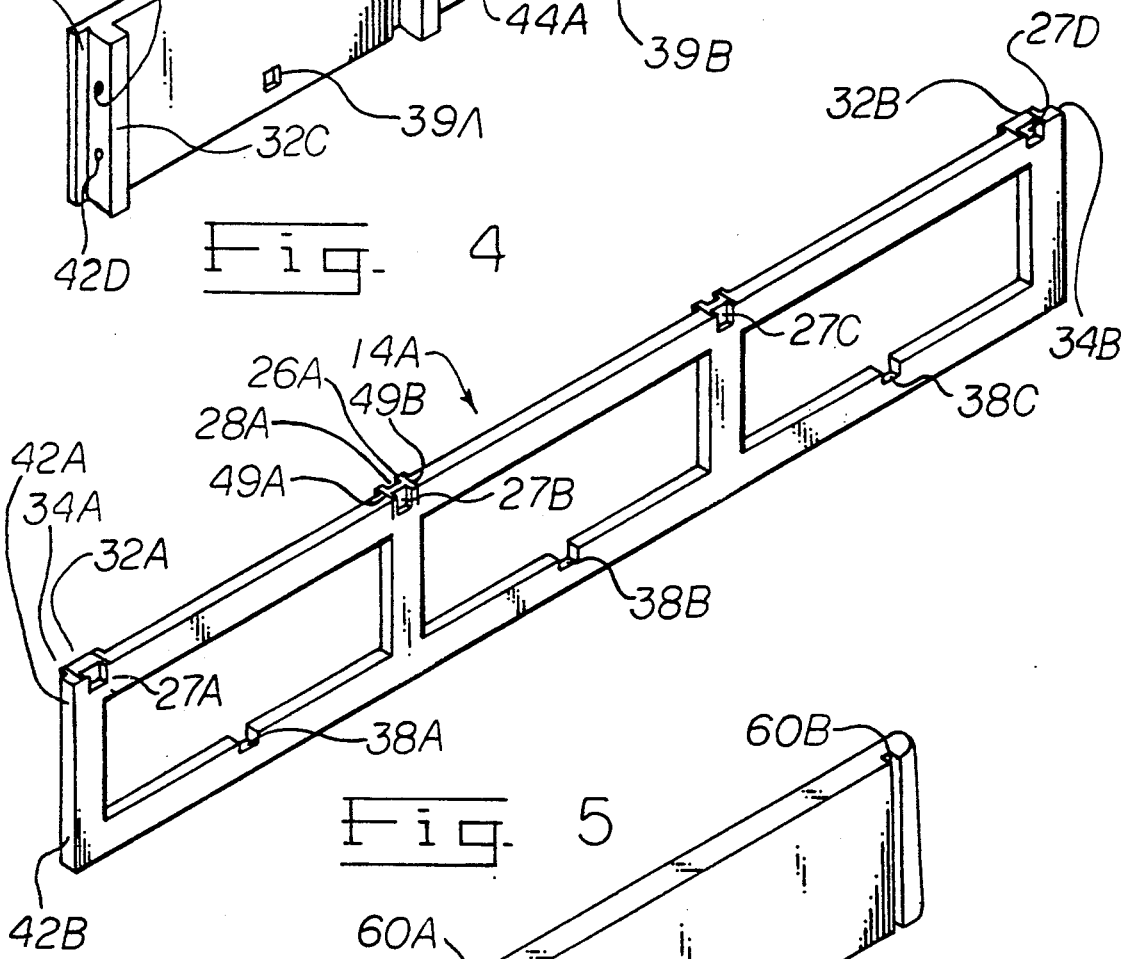
FIG. 4 is a side perspective view of an alternate second side panel of the frame unit of FIG. 1.

An assembled bed frame 94 as used with a double, king, queen or other wide box spring and mattress, coil spring or other combinations of body supports for sleeping is shown in FIG. 6. This frame 94 consists of two of the basic units placed side by side in spaced-apart relationship with drawer fronts 66 facing outwardly. The two units 12 are held in place by wooden center support spacers 93A, 93B, 93C and 93D which fit into notches 27A, 27B, 27C and 27D on the outside face of side panel 14 as shown in FIG. 4. Spacers 93A, 93B, 93C and 93D have predrilled guide holes for fastening spacers to panel 14.

Figure 11:
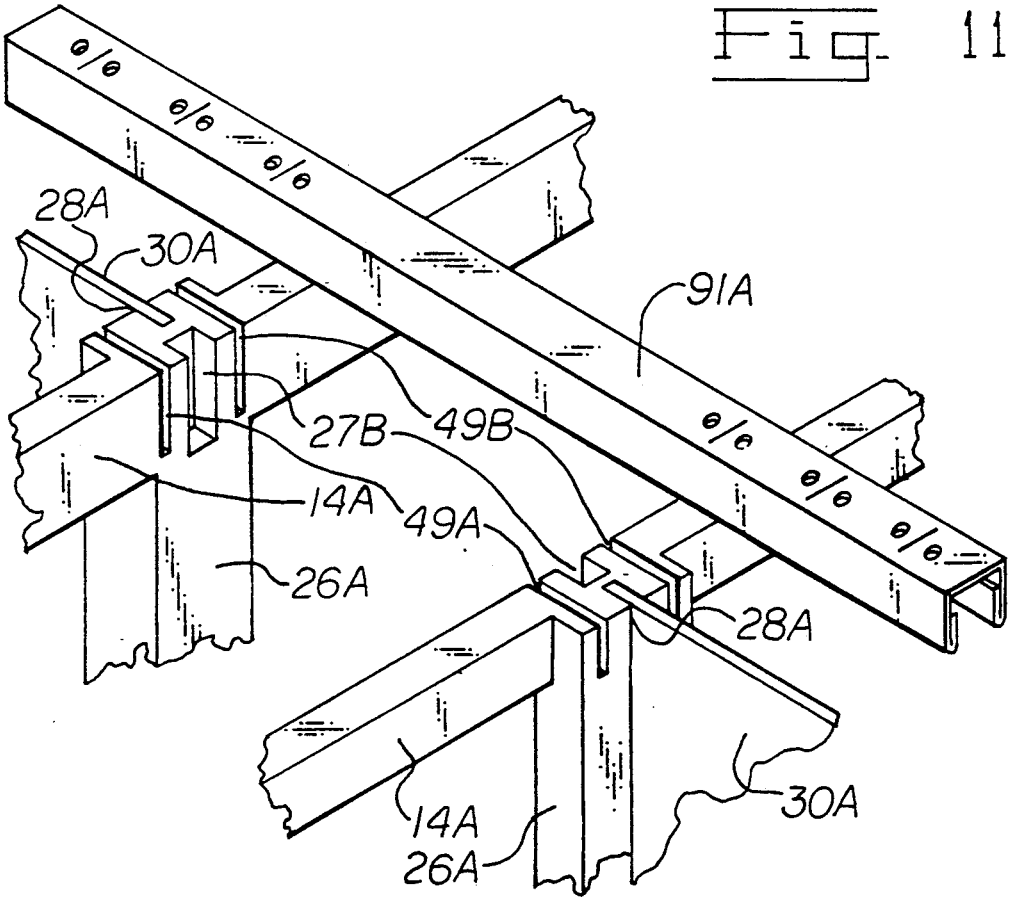
FIG. 11 is a partial exploded view of a frame and spacer member used in assembling frames for supporting mattresses and box springs of various widths.

Alternatively, the use of metal shaped support spacers 91A–91D also provides a high degree of versatility and innovation to the bed frame assembly 94. The combination of inverted U-shaped supports 91A–91D, marked for a predetermined length, to connect two of the basic units 12 together, provides a variety of assembly widths to accommodate from a standard or queen size or wider box springs and mattresses with the same frame assembly 94 without having to be cut to a predetermined length. Panel 14 also has thin grooves 49A–49B across the tops of members 26A–26B, 32A–32B and the top of panel 14 on both sides of slots 28A and 28B as shown in detail in FIG. 11. These accommodate inverted U-shaped spacers 91A, 91B, 91C and 91D.

By premarking the supports 91A–91D at intervals denoting the proper length to provide a predetermined width of the final assembly 94, the assembler confidently can position the frames to the width preselected and provide the correct width for the assembled bed frame 94. This innovation provides the versatility of using the present bed pedestal with mattresses, springs, box springs, or other sleeping supports of various widths. Additionally, by marking supports 91A–91D for various width mattresses and springs at the factory, a frame of predetermined width can be assembled without cutting by the retailer or user.

Figure 12:
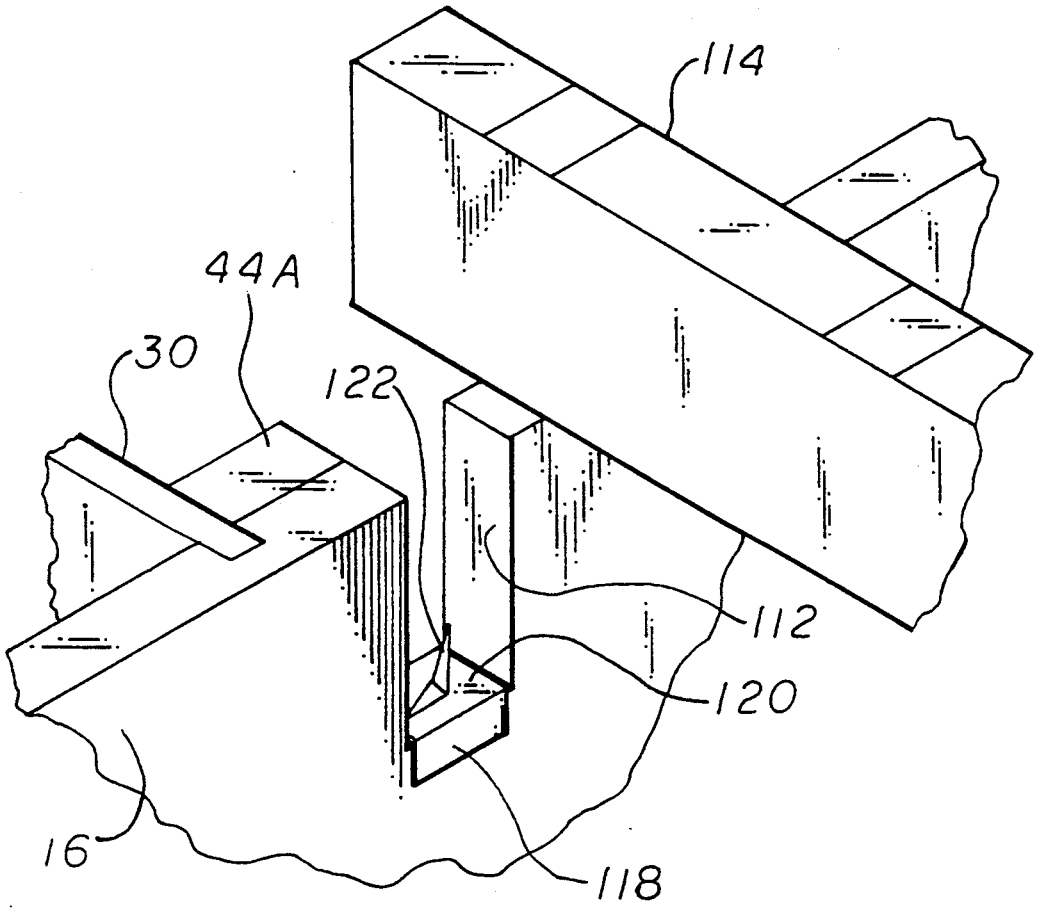
FIG. 12 is a fragmentary view of an alternative embodiment of a side panel showing another spacer means for use in connecting two pedestals together.

Another means for assembling a bed frame 94 from two basic units 12 as shown in FIG. 12 is to provide each of the side panels 16 with notches 112 adjacent each of the supports 44A and 44B on the side opposite slots 45A and 45B. Each notch 112 is of a shape and size to accommodate a spacer 114, usually of wood, which matches with and slips snugly into the notch 112. As with the other exemplified spacer embodiments, the spacers 114 will be premarked near each end to provide for assembly of a bed frame 94 of predetermined width.

Figure 13:
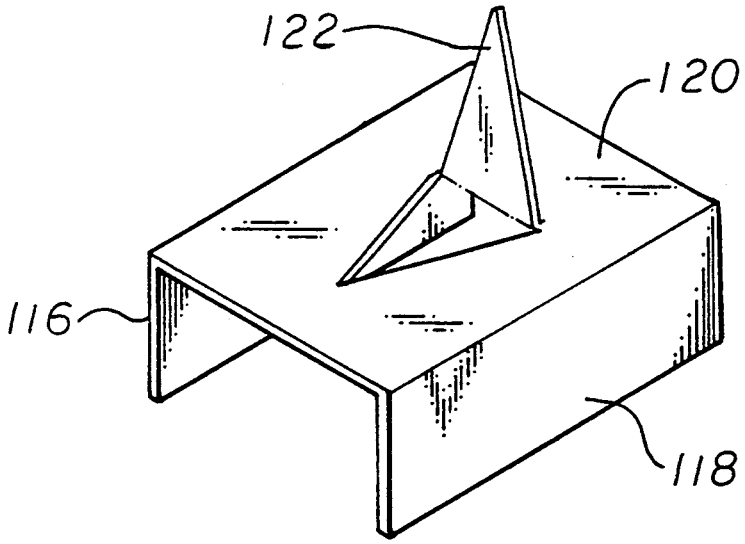
FIG. 13 is a metal clip member for use in the embodiment of FIG. 12.

A substantially⊓-shaped clip 116 fabricated to fit into notch 112 with its arms 118 fitting to mate with the side walls of the panel as shown in FIG. 13 holds the spacer 114 in fixed position. Conveniently, the base 120 of clip 116 can be fabricated to have a pointed, outwardly projecting member 122 upon which the bottom of spacer 114 is impaled and held in the assembly.

An unexpected advantage of the bed assembly 94 results from the additional storage space formed in the section between panels 14 and defined by the separator supports. For regular, double and queen size mattresses and box springs, the area between the foot boards 18 can be fitted with a single door 96 fastened to one of the foot boards 18 by hinges 98A, 98B. Conventional, mechanical, magnetic or other latching mechanisms can be used to hold the door 96 in place against the foot board 18 of the second unit 12 of assembly 94. For wider frame assemblies 94, such as are employed for king size mattresses and springs, for example, two doors 96 are generally used. These are designed to meet in the center opening between units 12 of assembly 94. One door 96 is fastened by hinges 98A, 98B to each foot board 18 and secured by a latching mechanism. Doors are centered according to pedestal width. For ease in opening the door 96, a groove (not shown) can be cut into the back face along its bottom edge to be used as a finger hold in opening and closing. Additionally, a keyed lock (not shown) can be used with doors 96 to secure the center compartment.

The open area between the units 12 at the back boards 20 can be closed off or sealed by a planar member 100 which is secured to the back boards 20. Member 100 can be of wood, plastic, corrugated cardboard or any other solid material. Corrugated cardboard from the packaging used to transport the component kit from which the units 12 and assemblies 94 are fabricated is quite suitable. This has the additional advantage in that the various sizes for different width assemblies 94 can be inscribed on the shipping container which further facilitates assembly. Also two cardboard strips from the shipping carton are marked to be of a size to cover the openings of the inner members 14 when such are used to provide solid walls for the center storage area and sealing off the drawers.

Figure 10:
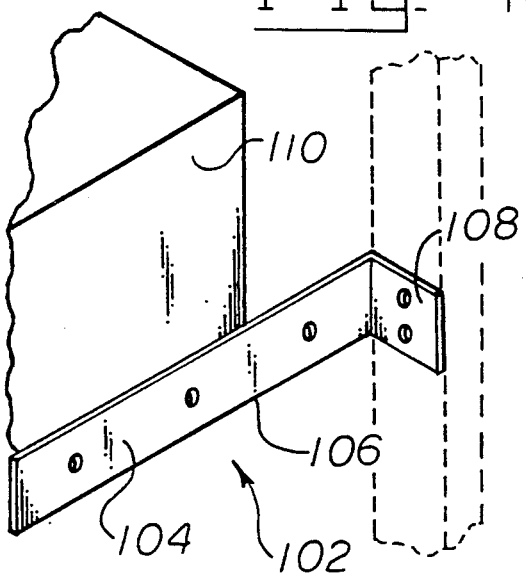
FIG. 10 is a front view of a bracket for use in attaching a headboard or footboard to a box spring supported by the frame of the present invention.

If it is desired to attach a bed headboard to assembly 94, this can be done conveniently using an L-shaped bracket member 102 of FIG. 10, which is considered to be an embodiment of my invention. As can be noted from FIG. 10 the short leg 108 of the bracket 102 in use is attached to the side or leg of a headboard of a bed 110 and the long arm 104 fastened to a bed spring base. As shown in the FIG. 10, brackets 102 are predrilled for receiving screws.

In the preferred embodiment of the bed frame assembly described hereinbefore and shown in the FIGS. of the drawing, for ease of assembly by the retailer or user, it has been manufactured in kit form for ready assembly with screws using only a screwdriver. However, if desired, it is contemplated that other means of securing the various components to each other can be used. These include, for example, adhesives, glues, nails and the like. However, for ease in assembly and disassembly, as well as providing a good, secure frame, use of screws is a convenient way of securing the components.

As shown and described, the preferred frame embodiment is constructed of wood, preferably pine or any other wood generally used for furniture construction. Cedar is particularly desirable, especially for the divider panels 30A and 30B, as well as for side panels 14 and 16 and footboard 18 and backboard 20 to provide moth protection. Other materials could be used, but these might require alternate securing and assembly means as will be known to one skilled in the art.

Conveniently, the bed frame assembly can be secured to a conventional box spring by screws, angle brackets or other means to hold the box spring in fixed position. The assembly also can be fastened to a wood platform or to each other for multiple stacking of units.

Various modifications can be made in the present invention without departing from the spirit or scope thereof; for it is understood that I intend that my invention is limited only by the scope of the appended claims.

I claim:

1. An adjustable bed frame assembly for supporting mattresses and springs of different widths which comprises;

(a) two substantially rectangularly shaped units, said units being joined in a predetermined spaced apart side by side relationship by spacer members wherein each of said substantially rectangularly shaped units is substantially of the same configuration, (b) each of said substantially rectangularly shaped units comprising two side panels, two spacer panels, a footboard and a backboard and wherein at least one of said side panels defines three rectangular openings each of a size to provide for entry of a drawer, the interior face of each of said side panels between said openings having vertical support members containing slots extending their length, said slots designed to slidably engage ends of interior divider panels which extend widthwise between the interior faces of said side panels, said side panels having vertical support members adjacent each end, said support members being positioned inwardly a short distance from the ends of said side panels defining open face right-angle notches extending from the top to the bottom of these panels, said foot board having vertically walled grooves extending from top to bottom near each end which mate with the outer extensions of the notches in one end of the side panel and said footboard and backboard being fastened to said side panels at said open face notches at the ends of said panels, the center of the lower edge of each of said rectangular openings in said side panels containing a notch, said notch designed to hold one end of the bottom segment of a drawer slide, one of said side panels having thin grooves across its width at the top of said panel at the location of the vertical support members, said thin grooves in said side panels and vertical support members containing the side walls of an inverted right-angled shaped spacer member, said rectangular openings in the face of one side panel of said bed frame assembly being fitted in its lower edges near the side walls with drawer rollers, said drawers comprising a front, two sides, a bottom, a back and a drawer slide, the drawer front being of a size larger that the rectangular opening in the side panel of the bed frame unit, the middle of the inside face of said drawer front containing a depression near the bottom to hold one end of the second half of the drawer slide which mates with the drawer slide member in said rectangular bed frame unit, said drawer face also having vertical grooves at predetermined distances inwardly from its ends such that one end of each of said drawer slides fits snugly therein, the positioning of said sides providing that these fit snugly but slidably within the side walls defining the rectangular openings in said side panel, each of said side members of said drawer having narrow grooves in the interior face near the bottom edge extending horizontally along the length of the said side members slidably engaging said drawer bottom, each of said side members also defining a vertical groove near the end opposite that which fits into the grooves in said drawer face, said grooves holding the back of said drawer, and (c) said spacer members being marked at intervals along their length to define a predetermined width of said bed frame assembly.

2. The bed frame assembly as defined in claim 1 having a door fastened by hinges to the footboard of one of said substantially rectangular units, said door being of a size and configuration to cover the open area defined by the rectangular units in their spaced apart side by side relationship and a planar member fastened to the backboards of said rectangular units covering the opening defined by the rectangular units in their spaced apart side by side relationship.

3. The bed frame assembly as defined in claim 1 and having a door fastened by hinges to each of the foot boards said doors meeting in the center between the spaced apart units and having a planar member fastened to the back boards of the rectangular units covering the opening defined by the rectangular units in their spaced apart side by side relationship.

4. The bed frame assembly as defined in claim 1 wherein one of the side panels of each of said rectangular units is solid and contains blind openings in its interior face which locate and hold one end of the drawer slides.

5. The bed frame assembly of claim 1 supporting a spring and mattress and fastened to a bed headboard, and to a bed footboard by right-angled brackets at each corner of the bed frame assembly.

6. The adjustable bed frame assembly of claim 1 wherein the spacer members are wood.

7. The adjustable bed frame assembly of claim 1 wherein the inverted right-angled shaped spacer member is metal.

8. The adjustable bed frame assembly of claim 1 wherein the inverted right-angled shaped spacer member is pre-marked at predetermined intervals and contains pre-positioned openings for joining the rectangular units at predetermined spaced apart distances.

9. A substantially rectangular support unit for use in a bed frame assembly which comprises two side panels, intermediate spacer panels, a footboard, a bottom support stringer, a backboard and at least one drawer, one of said side panels defining a predetermined number of rectangular openings each of a size to provide for entry of a drawer, the interior face of said side panel between said openings having vertical support members containing slots extending their length, said slots designed to slidably engage ends of said intermediate spacer panels which extend widthwise between the interior faces of the two side panels in an assembled unit, said side panels having vertical support members adjacent each end, said support members being positioned inwardly a short distance from the ends of said side panels and defining open face right angle notches extending from the top to bottom of the two side panels, the center of the lower edge of each of said rectangular openings in one side panel containing a notch, said notch designed to hold one end of the bottom segment of a drawer slide, the second side panel being a solid member but containing the same vertical supports, the footboard and backboard being fastened to said side panels at said open face notches at the ends of said panels, a bottom support stringer positioned intermediate said side panels and extending lengthwise from the footboard to the backboard. the end of each said stringer fitting into a blind notch in the inside face of said footboard and backboard, said stringer containing notches in line with those in the lower edge of said rectangular openings in the first side panel for securing the second end of the bottom segment of said drawer slide, the intermediate spacer panel and stringer having mating notches which hold and position the support stringer, the rectangular openings in said side panel having drawer rollers at their lower edges, said drawers comprising a front, two sides, a bottom, a back and a drawer slide, the drawer front being of a size larger than the rectangular opening in the side panel of the frame unit, the middle of the inside face of said drawer front containing a depression near the bottom to hold one end of the second half of the drawer slide which mates with the drawer slide member in said rectangular unit, said drawer face also having vertical grooves at predetermined distances inwardly from its ends such that one end of each of said drawer sides fits snugly therein, the positioning of said sides providing that these fit snugly but slidably within the side walls defining the rectangular openings in said side panel, each of said side members of said drawer having narrow grooves in their interior face near the bottom edge extending horizontally along the length of said side, these grooves slidably engaging said drawer bottom, each of said sides also defining a vertical groove near the end opposite that which fits into the grooves in said drawer face, said grooves in the sides holding the back of said drawer, the footboard having vertically walled grooves extending from top to bottom near each end which mates with the outer extensions of the notches on one end of the side panels.

10. An adjustable bed frame assembly for supporting mattresses and springs of different widths which comprises:

(a) two substantially rectangularly shaped support units, said units being joined in a predetermined spaced-apart side by side relationship by spacer members wherein each of said substantially rectangularly shaped units is substantially of the same configuration and comprises two side panels, intermediate spacer panels, a footboard, a bottom support stringer, a backboard and at least one drawer, one of said side panels defining a predetermined number of rectangular openings each of a size to provide for entry of a drawer, the interior face of said side panel between said openings having vertical support members containing slots extending their length, said slots designed to slidably engage ends of said intermediate spacer panels which extend widthwise between the interior faces of the two side panels in an assembled unit, said side panels having vertical support members adjacent each end, said support members being positioned inwardly a short distance from the ends of said side panels and defining open face right angle notches extending from the top to bottom of the two side panels, the center of the lower edge of each of said rectangular openings in one side panel containing a notch, said notch designed to hold one of the bottom segment of a drawer slide, the second side panel being a solid member but containing the same vertical supports, the footboard and backboard being fastened to said side panels at said open face notches at the ends of said panels, a bottom support stringer positioned intermediate said side panels and extending lengthwise from the footboard to the backboard, the end of each said stringer fitting into a blind notch in the inside face of said footboard and backboard, said stringer containing notches in line with those in the lower edge of said rectangular openings in the first side panel for securing the second end of the bottom segment of said drawer slide, the intermediate spacer panel and stringer having mating notches which hold and position the support stringer, the rectangular openings in said side panel having drawer rollers at their lower edges, said drawers comprising a front, two sides, a bottom, a back and a drawer slide, the drawer front being of a size larger than the rectangular opening in the side panel of the frame unit, the middle of the inside face of said drawer front containing a depression near the bottom to hold one end of the second half of the drawer slide which mates with the drawer slide member in said rectangular unit, said drawer face also having vertical grooves at predetermined distances inwardly from its ends such that one end of each of said drawer sides fits snugly therein, the positioning of said sides providing that these fit snugly but slidably within the side walls defining the rectangular openings in said side panel, each of said side members of said drawer having narrow grooves in their interior face near the bottom edge extending horizontally along the length of said side, these grooves slidably engaging said drawer bottom, each of said sides also defining a vertical groove near the end opposite that which fits into the grooves in said drawer face, said grooves in the sides holding the back of said drawer, the footboard having vertically walled grooves extending from top to bottom near each end which mates with the outer extensions of the notches on one end of the side panels, the solid panel having a notch adjacent each vertical support member, each of said notches accommodating a wooden spacer, a substantially ⊓-shaped clip fitting into each of said notches wherein the arms mate with the side walls of the panel, said clip having a pointed, outwardly projecting member extending outwardly from its base and impaling and holding the bottom of said spacer in the bed frame assembly, and (c) said spacer members being marked at intervals along their length to define a predetermined width of said bed frame assembly.

* * * * *